United States Patent [19]

Thall et al.

[11] 4,149,908

[45] Apr. 17, 1979

[54] METHOD FOR BLACKENING THE SURFACES OF A BODY OF FERROUS METAL

[75] Inventors: Earle S. Thall, Leola; John J. Moscony, Lancaster, both of Pa.

[73] Assignee: RCA Corporation, New York, N.Y.

[21] Appl. No.: 836,422

[22] Filed: Sep. 26, 1977

[51] Int. Cl.[2] ..... C23F 7/04

[52] U.S. Cl. ..... 148/6; 148/6.11; 148/6.14 R

[58] Field of Search ..... 148/6.11, 6, 6.14 R

[56] References Cited

U.S. PATENT DOCUMENTS

| | | | |
|---|---|---|---|
| 2,289,443 | 7/1942 | Mange | 148/6.14 R |
| 2,618,578 | 11/1952 | Kreml | 148/6.11 |
| 3,085,035 | 4/1963 | Ireland et al. | 148/6.14 R |
| 3,437,532 | 4/1969 | Helgert et al. | 148/6.11 |
| 3,540,942 | 11/1970 | Lewis et al. | 148/6.11 |
| 3,867,207 | 2/1975 | Decker et al. | 148/6.14 R |
| 3,935,036 | 1/1976 | Kinsch | 148/6.16 |

*Primary Examiner*—Ralph S. Kendall

*Attorney, Agent, or Firm*—E. M. Whitacre; G. H. Bruestle; L. Greenspan

[57] ABSTRACT

The surfaces of a ferrous metal body are coated with a heat-fusible, chemically-oxidizing composition, such as sodium nitrate or potassium nitrate. Then, the coated body is heated above the melting temperature of the coating, preferably above 350° C., until the coating melts, spreads over the surfaces, reacts with the material of the surfaces and produces a black oxide coating thereon.

9 Claims, 2 Drawing Figures

METHOD FOR BLACKENING THE SURFACES OF A BODY OF FERROUS METAL

BACKGROUND OF THE INVENTION

This invention relates to a method for blackening the surfaces of a body of ferrous metal. The invention is particularly applicable to blackening the surfaces of a mask-frame assembly for a shadow-mask-type color television picture tube.

The mask-frame assembly for a color television picture tube usually comprises an apertured mask welded to a frame or other support, and is mounted in the tube with the mask closely spaced from the viewing screen of the tube. The surfaces of the mask and frame, which are usually of a ferrous metal such as cold-rolled steel, are blackened to reduce or prevent corrosion during the manufacture of the tube, to increase the dissipation of heat generated in the mask and frame during the operation of the tube, and to reduce reflections of visible light during the viewing of video images on the viewing screen of the tube. The blackening is a layer of black iron oxide that is so thin that it does not affect the dimension of the parts.

Several methods of blackening the surfaces of the mask, frame and other ferrous-metal parts with a thin black oxide layer have been suggested. The most common methods include baking the parts at about 600° C. in a wet reducing atmosphere. Other methods include applying a strong oxidizing acid mixture to the surfaces and then, after rinsing, baking the parts at about 400° to 500° C. While these processes do the job, nevertheless, it is desirable to reduce the cost of blackening in terms of reducing material, fuel, handling and capital expenses.

Oxidizing salts, such as sodium nitrate and potassium nitrate, are known to blue or blacken steel surfaces and have been used for this purpose for many years. The accepted practice is to immerse the steel parts to be blackened for several minutes into the fused molten salts or hot concentrated aqueous solutions of the salts. While these treatments are useful for massive parts, they are unsatisfactory for masks which are light in weight and delicate in structure and are easily distorted by the treatment in hot liquids. Also, in the case of the mask-frame assembly, the mass difference between the mask and the frame is so great that gross distortions result when the assembly is immersed in the hot molten salt or hot solution. Except for these problems, the use of such oxidizing salts to blacken the mask and frame is desirable since the required materials are cheap, the required reaction temperatures are lower than those normally used, and there is the possibility of lower handling and capital costs.

SUMMARY OF THE INVENTION

In the novel method, the surfaces to be blackened are coated with a heat-fusible composition which contains compounds, such as sodium nitrate and potassium nitrate, which are oxidizing to ferrous metal. The surfaces may be coated, for example, by spraying with an aqueous solution of the composition and then drying the coating. Then, the coated surfaces are heated above the melting temperature of the composition, preferably in the 300° to 550° C. range, until the coating melts, spreads over the surfaces, reacts with the surfaces and produces the desired black oxide coating.

The novel method may be applied to assemblies of parts with different masses or to the individual parts separately. The novel method may be applied to parts with light delicate structure as well as to massive parts. The lower cost of the novel method results from lower material costs, lower capital costs, lower handling costs and lower reaction temperatures requiring less fuel. Also, because of the lower reaction temperature, the heating may be combined with another heating step in making the mask-frame assembly. For example, it is the practice, after the mask is welded to the frame, to heat the assembly to about 450° to 460° C. to impart better dimensional stability to the assembly. The heating step in the novel method may be combined with that other heating step.

DESCRIPTION OF THE PREFERRED EMBODIMENTS

The novel method may be applied to blacken the surfaces of any body of ferrous metal. As shown in the flow-sheet diagram of FIG. 1, only two major steps are involved. In the first step, shown in box 21, a surface, or surfaces, of a ferrous metal body, such as hot- or cold-rolled steel, is coated with a heat-fusible composition containing an oxidizing compound.

The oxidizing compound is preferably an alkali metal nitrate since such nitrates melt in the range of 200° to 450° C. Sodium and potassium nitrates, which have melting points of 370° C. and 334° C. respectively, are preferred within this group. However, other heat-fusible, oxidizing compounds, such as bromates and chlorates of sodium and potassium, with melting points in the range of 200° to 450° C., may be used. Besides the oxidizing compound, other constituents, such as wetting agents, may be present in the coating composition, although they are not necessary for the novel method.

The coating composition may be applied in any convenient way. A preferred coating method is to dissolve the coating composition in water, then to spray a controlled thickness of the coating solution on the desired surfaces of the ferrous body, and then to dry the coating. If the body is warm, the coating will dry on contact or soon thereafter, which is desirable to prevent rusting. Instead of spraying, the coating solution can be poured or flowed over the surfaces of the body and then dried. Or, the surfaces of the body can be dipped into the coating solution and then dried. The temperatures of the coating solution and body are generally below 50° C. and preferably at, or near, room temperature. The solution can be warm, but, unlike prior blackening methods, the solution is not so hot as to produce any substantial reaction with the ferrous surfaces which it contacts. Also, the oxidizing compound can be applied as a loose dry powder to the surface of the body provided the applied material is not disturbed before it fuses and sticks to the ferrous-metal surface.

Figure 1:
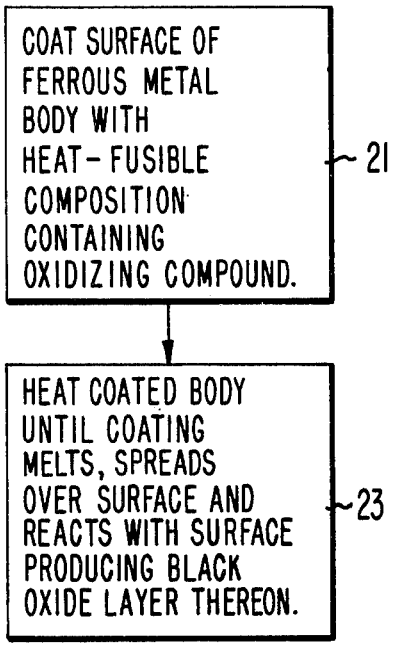
FIG. 1 is a flow-sheet diagram of the novel method broadly defined.

In the second step, shown by the box 23 of FIG. 1, the dry coated body is heated at temperatures and for time intervals which cause the coating to melt and spread over the ferrous surfaces and react therewith to form a black oxide layer thereon. Since the coating spreads over the surfaces of the body during the heating step, it is not necessary to cover completely the surfaces during the coating step; thus, the overlapping surfaces of assemblies of ferrous bodies will be covered by the spreading of the material during the heating step. The required temperature, of course, depends on the melting temperature of the coating composition and particularly the melting temperature of the oxidizing compound. Also, the higher the temperature, the shorter the time required to produce the desired reaction with the ferrous surfaces. Heating temperatures in the range of 300° to 550° C. for about 5 to 10 minutes have been found to be adequate for any of the alkali nitrates. Where nitrates are used, continued heating after the reaction is complete does no harm, and may decompose any excess coating material into harmless volatile fragments. The heating is preferably conducted in air in an ordinary lehr. The heating step may be carried out solely for blackening the body or may be used to blacken the body and also carry out some other process step such as annealing or other metal treatment.

The novel method is particularly useful for blackening various of the parts of shadow-mask color tubes. Such tubes are described in detail elsewhere, for example, in U.S. Pat. No. 3,803,436 to A. M. Morrell and in *Color Television Picture Tubes* by A. M. Morrell et al., Academic Press, New York, 1974, particularly at pages 42 to 134, and need not be redescribed herein. One common construction of such tubes includes a thin sheet or mask of ferrous metal having therein a multiplicity of apertures of almost any shape in a prescribed array mounted on a more massive support. Typically, the mask is about 0.10 to 0.20 mm thick, with a domed central apertured portion and a peripheral skirt integral with the margins of the domed portion. The mask is welded near the extended edges of the skirt to the support, or frame, which has an L-shaped cross section.

In the prior method of construction, the surfaces of each of the mask and the frame were blackened prior to being welded together. Then, subsequent to welding, the mask-frame assembly was heated to improve the dimensional stability of the assembly. The novel method may be substituted for the prior method of blackening, for example, as described below in Examples 1 and 2. That is, the mask or frame can be coated with a coating composition and then heated to the temperatures which melt the coating and cause the black oxide film to form. Then, the mask and frame can be assembled, welded and the assembly heated to improve its dimensional stability. This involves two heatings as before.

Figure 2:
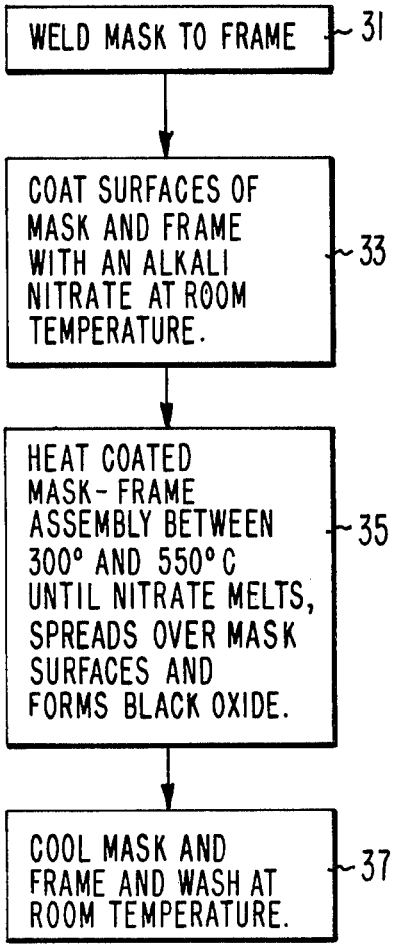
FIG. 2 is a flow-sheet diagram of a specific embodiment of the novel method.

With the novel method, one heating can be used for both of these purposes as shown in the specific embodiments of FIG. 2. The mask and frame can be assembled and welded together before blackening, as shown in the box 31. Then, the novel method is applied to the mask-frame assembly in which the heating step serves both to form the black film on the mask and frame surfaces and also to improve the dimensional stability of the assembly. After welding the mask to the frame, the surfaces of the welded assembly are coated with an alkali nitrate at about room temperature as shown in the box 33. Then, the coated assembly is heated in air for a few minutes at 300° to 550° C. to produce the black oxide film, as shown by the box 35. Finally the assembly is cooled, washed with water as shown by the box 37 and dried. Thus, only one heating is required with a consequent saving in fuel, handling and capital equipment. This embodiment is exemplified below in Example 3.

The surfaces of other ferrous metal structures for a cathode-ray tube can be blackened with the novel method. For example, the ferrous-metal shields described in U.S. Pat. Nos. 3,822,453 and 3,867,668, both to T. M. Shrader, may be blackened by the novel method prior or subsequent to assembly with the mask and frame. In the following examples, the masks and frames are of low-carbon cold-rolled steel.

EXAMPLE 1

Prepare a 25 weight percent solution of potassium nitrate in water. Then, air spray the surfaces of a clean formed shadow mask with the solution at about room temperature to produce a light coating thereon. Dry the coating in air. Preferably, the mask is warm (preheated to about 30° and 50° C., for example) so that the sprayed material dries rapidly after spraying. Then, place the coated mask in an oven having a temperature of about 450° C. for about 5 minutes. Remove the mask from the oven, allow it to cool, rinse the mask with deionized water to remove residual salts and then dry the mask. The surface has formed therein a black oxide film which is believed to be iron oxide. The film is adherent and resists corrosion due to oxidation on reheating at 450° C. in air and due to contact with salt-water spray. The blackened mask can be welded to a ferrous-metal frame which has been similarly blackened.

EXAMPLE 2

Follow the procedure of Example 1 except substitute sodium nitrate for potassium nitrate and a support frame for the mask. A black oxide film is formed on the surfaces of the support which resists corrosion and can be welded to.

EXAMPLE 3

Provide a clean formed mask and a clean formed frame. Assemble and weld the mask to the frame. Then spray coat the surfaces of the mask and the frame with a 20 weight percent solution of potassium nitrate. Dry the coating, and then place the mask-frame assembly in an oven at about 450° C. for about 6 minutes. Then remove the assembly from the oven, cool to room temperature, wash the surfaces of the assembly with deionized water to remove residues, and then dry the surfaces. An adherent, black, corrosion-resistant, oxide film is formed on the surfaces of the mask and frame. Even though the mask and frame have different masses, the black films appear to be uniform, even in the overlapping areas, and no mechanical distortion is apparent in the frame or mask.

We claim:

1. A method for blackening a surface of a body of ferrous metal comprising the steps of:

(a) coating said surface with a heat-fusible composition which is oxidizing to said ferrous metal, said composition consisting essentially of a salt of an alkali metal and at least one member of the group consisting of nitrate, chlorate and bromate, said coating step being performed at temperatures at which no substantial reaction occurs between said surface and said composition, (b) and heating said coated body above the melting temperature of said composition until said composition melts, spreads over said surface, reacts with the material of said surface and produces a black oxide layer thereon.

2. The method defined in claim 1 wherein said composition is coated at temperatures below about 50° C. and said composition melts at temperatures between about 200° and 450° C., and said coated body is heated at temperatures between 300° C. and 550° C.

3. The method defined in claim 1 wherein said composition consists essentially of an alkali metal nitrate which melts at temperatures between about 300° and 350° C.

4. In a method for preparing a mask-panel assembly for a cathode-ray tube including the steps of:

(a) providing a ferrous apertured mask and a frame therefor, (b) welding said mask to said frame, (c) coating surfaces of said mask and frame at substantially room temperature with a heat-fusible composition which is oxidizing to said ferrous apertured mask, said composition consisting essentially of a salt of an alkali metal and at least one member of the group consisting of nitrate, chlorate and bromate, (d) and heating said mask and frame at temperatures sufficient to melt said composition and for a sufficient time period to spread said molten composition over said surfaces and to react with said surfaces, whereby a black oxide coating is formed thereon.

5. The method defined in claim 4 wherein said composition consists essentially of at least one member of the group consisting of sodium nitrate and potassium nitrate and said heating step (d) is conducted in air at temperatures between about 300° and 550° C.

6. The method defined in claim 4 wherein said heating step (d) is conducted for a sufficient time period to relieve stresses in said mask and frame.

7. The method defined in claim 4 including, subsequent to step (d), the steps of cooling said mask and frame to room temperature and then washing said surfaces with a solvent to remove any residue thereon.

8. The method defined in claim 4 wherein said composition consists essentially of alkali metal nitrates, and said coating step (c) is conducted by dissolving said nitrates in an aqueous medium, applying the resultant nitrate solution to said surfaces, and then drying said surfaces.

9. The method defined in claim 8 wherein said coating step (c) is conducted by preheating said surfaces, spraying an aqueous solution of said composition on said preheated surfaces, whereby said surfaces dry immediately after spraying.

* * * * *